US011028998B2

(12) United States Patent
Jones

(10) Patent No.: US 11,028,998 B2
(45) **Date of Patent: *Jun. 8, 2021**

(54) MULTI-COLOR HUNTING SPOTLIGHT

(71) Applicant: ALLPREDATORCALLS.COM, INC., St. George, UT (US)

(72) Inventor: Andrew Paul Jones, St. George, UT (US)

(73) Assignee: ALLPREDATORCALLS.COM, INC., St. George, UT (US)

( * ) Notice: Subject to any disclaimer, the term of this patent is extended or adjusted under 35 U.S.C. 154(b) by 69 days.

This patent is subject to a terminal disclaimer.

(21) Appl. No.: 16/261,409

(22) Filed: Jan. 29, 2019

(65) Prior Publication Data

US 2019/0170329 A1 Jun. 6, 2019

Related U.S. Application Data

(63) Continuation of application No. 15/924,058, filed on Mar. 16, 2018, now Pat. No. 10,208,924, and a (Continued)

(51) Int. Cl.
*F21V 14/02* (2006.01)
*F21V 14/06* (2006.01)

(Continued)

(52) U.S. Cl.
CPC ..... *F21V 14/025* (2013.01); *F21L 4/027* (2013.01); *F21S 10/026* (2013.01); *F21V 5/04* (2013.01);

(Continued)

(58) Field of Classification Search
CPC ..... F21V 14/025; F21V 5/04; F21V 23/0414; F21V 19/001; F21V 14/065; F21S 10/026;

(Continued)

(56) References Cited

U.S. PATENT DOCUMENTS 3,261,972 A * 7/1966 Stahl ..... F21V 23/0414 362/205
6,016,038 A 1/2000 Mueller et al.

(Continued)

FOREIGN PATENT DOCUMENTS

CN 201487570 U * 5/2010
CN 203656596 U 6/2014

OTHER PUBLICATIONS

CN201487570U, May 2010, machine translation (Year: 2010).*

*Primary Examiner* — Tracie Y Green
(74) *Attorney, Agent, or Firm* — Gurr Brande & Spendlove, PLLC.; Robert Dan Spendlove

(57) ABSTRACT

A multi-color spotlight has a housing having a lens on a first side, a rotational LED mechanism, a knob for actuating the rotational LED mechanism, and a power supply source within the housing operably coupled to the rotational LED mechanism, wherein the rotational LED mechanism comprises a rotatable rod having a plurality of substrates coupled around the circumference thereof, with each substrate being in a distinct geometric plane, each substrate having an LED chip in the center, and wherein only the LED chip that is positioned in the center beneath the lens is configured to receive power from the power supply source.

20 Claims, 4 Drawing Sheets

Related U.S. Application Data continuation of application No. 15/379,876, filed on Dec. 15, 2016, now Pat. No. 9,951,928.

(51) Int. Cl.

| | |
|---|---|
| ***H05B 33/08*** | (2020.01) |
| ***F41G 1/35*** | (2006.01) |
| ***F21V 5/04*** | (2006.01) |
| ***F21L 4/02*** | (2006.01) |
| ***F21V 19/00*** | (2006.01) |
| ***F21V 23/04*** | (2006.01) |
| ***F21S 10/02*** | (2006.01) |
| ***F21V 19/02*** | (2006.01) |
| ***H05B 45/10*** | (2020.01) |
| ***H05B 45/20*** | (2020.01) |
| *F21Y 115/10* | (2016.01) |
| *F21Y 113/10* | (2016.01) |

(52) U.S. Cl.

CPC ..... *F21V 14/065* (2013.01); *F21V 19/001* (2013.01); *F21V 19/02* (2013.01); *F21V 23/0414* (2013.01); *F41G 1/35* (2013.01); *H05B 45/10* (2020.01); *H05B 45/20* (2020.01); *F21Y 2113/10* (2016.08); *F21Y 2115/10* (2016.08)

(58) Field of Classification Search

CPC ... F41G 1/35; H05B 33/0857; H05B 33/0845; F21L 4/027; F21Y 2115/10; F21Y 2113/10

See application file for complete search history.

(56) References Cited

U.S. PATENT DOCUMENTS

| | | | | |
|---|---|---|---|---|
| 6,626,557 | B1 * | 9/2003 | Taylor | F21V 21/116 362/235 |
| 7,168,828 | B2 | 1/2007 | Schmidt et al. | |
| 7,621,653 | B2 | 11/2009 | Hendrie | |
| 7,722,209 | B2 * | 5/2010 | Matthews | F21L 4/027 362/205 |
| 8,366,292 | B2 | 2/2013 | McDermott | |
| 8,456,107 | B2 | 6/2013 | Salm | |
| 8,757,809 | B2 | 6/2014 | Jorgensen | |
| 9,217,558 | B2 * | 12/2015 | Sparing | H05B 45/00 |
| 9,732,942 | B2 | 8/2017 | Jorgensen | |
| 9,951,928 | B2 * | 4/2018 | Jones | H05B 45/10 |
| 9,995,468 | B2 | 6/2018 | Liang | |
| 10,088,138 | B2 * | 10/2018 | Shoulders | F21L 4/027 |
| 10,485,066 | B2 | 11/2019 | Catalano | |
| 2014/0240969 | A1 * | 8/2014 | Chen | F21L 4/005 362/187 |
| 2018/0274759 | A1 * | 9/2018 | Jones | F41G 1/35 |
| 2019/0003658 | A1 * | 1/2019 | Sharrah | F21V 14/025 |

* cited by examiner

MULTI-COLOR HUNTING SPOTLIGHT

CROSS-REFERENCE TO RELATED APPLICATIONS

This application is a continuation of U.S. Non-Provisional patent application Ser. No. 15/924,058 filed Mar. 16, 2018, which is a continuation of U.S. Non-Provisional patent application Ser. No. 15/379,876 filed Dec. 15, 2016, now U.S. Pat. No. 9,951,928.

TECHNICAL FIELD

The present disclosure relates to spotlights. More particularly, the present disclosure relates to night hunting spotlights, both mountable on a firearm and handheld.

BACKGROUND

Night hunting is a very popular sport around the world. In the sport of nighttime predator and invasive feral and pest species hunting (e.g., coyote, fox, jackal, feral hog, wild boar, leopard, rat, bobcat, etc.), a very common technique is to use spotlights to shine on open or baited areas ("scanning") while playing recordings of distressed indigenous game animals, such as rabbits or deer (in the case or predatory animals). When light shines into the eye of an animal having a tapetum lucidum, the pupil appears to glow brightly (referred to as "eyeshine"). A hand-held flashlight is sufficient to produce eyeshine that is highly visible to humans at distances of several hundred yards. As such, spotlighting is used by naturalists and hunters to search for animals at night.

When the responding predator arrives in the area, the shined light causes the animal's eyes to reflect brilliantly, alerting the hunter or naturalist as to the animal's arrival on scene. The scanning light color used has always been a topic of fierce debate among night hunters, with the prevailing school of thought accepting the premise that colored lights (as opposed to white lights) reduce the potential of spooking the animal or overwhelming the animal's eyes with bright, high-intense light, and causing the targeted species to shy from the light.

However, not all animals have tapetum lucidum. For example, wild boar and feral hogs are an animal frequently hunted at night, but that lack the tapetum lucidum. Because of this, a light is needed that illuminates the actual body of the wild boar or feral hog so the hunter can detect the animal and positively identify it. Green light is most often used because of its minimal effect on hogs (does not spook them) and because the human eye sees better detail at distance under green colored light as opposed to red (another common color used in hunting). The three most common techniques of targeting wild boar and feral hogs at night are: 1) hunting at night over baited areas with corn and/or feeders with visible light; or, 2) shining visible light on pastures that wild boar and feral hogs are known to frequent while feeding or rooting; or, 3) employing a night vision device with an attached light mechanism emitting invisible or nearly invisible Infrared (IR) light in the 810-940 nanometers range and scanning for targeted animals.

Until fairly recently (last 5-7 years), most night hunting lights were typically handheld utility spotlights incorporating a vertical handle grip and white bulb/element with a red or green plastic filter over the reflector housing to change the white light to a red or green color. A significant disadvantage is the large bulky nature of the typical spotlight design and the need to use a plastic colored filter over a white light, which reduces the light output by up to 70 percent—significantly reducing the effective range. Another disadvantage is that most are not mountable on a scope or optic due to their typically large size, vertical handle grip, and heavy battery packs.

More recently, smaller, more powerful handheld flashlights with either a single white or a single colored light-emitting diode ("LED") light have become popular for night hunting. However, most hunters prefer to use more than one color (e.g., red and green) for targeting different animals. Because the typical handheld light only has a single LED, a user must carry more than one light, which is burdensome. Attempts have been made to solve this problem, such as by having interchangeable LEDs on a light. However, this not only takes time and is very inconvenient, but it requires the user to select and install the LED prior to arriving on the hunting stand location or the beginning of the playing of distress animal recordings. Because multiple terrain habitat types, expected shooting distances, and different targeted species can be encountered (and/or target species changed) in a single night of hunting, multiple changes in LED color are warranted, but are inconvenient and time consuming. Further, the LEDs can easily become lost while attempting to change in darkness. Other designs have included more than one LED on the circuit board. However, because the LEDs are in a physically distinct position, the beam position in relation to the centerline of the flashlight changes with the activation of each individual LED on the circuit board. This makes it incredibly difficult to use in conjunction with a firearm-mounted light—with each change in color, the light position must be manually adjusted (e.g., windage/elevation adjustment knobs) to match the scope field of view and ensure the light beam is centered in the scope cross hairs. The light beam is also not centered in the spherical or Fresnel lens, which reduces the overall brightness and range of the light. As such, there is a need for a spotlight that can have more than one color of light beam which is quickly and effortlessly selectable, that maintains the light beam of each color in the same exact centered location in relation to the flashlight centerline, and that is lightweight and easily mountable on a firearm.

Even more recently, digital devices designed and optimized for night hunting with IR lights have become more common place (e.g., GEN 3+ Night Vision). The IR lights are utilized and configured with various IR emitters (typically in the 810-940 nanometer range). These IR emitters produce light in a light spectrum, which, depending upon the nanometer range, is nearly, to completely, invisible unless using it with a night vision device. When used with a passive night vision device, the IR LED drastically extends the detection and targeting range of the device as compared to use without supplemental IR lighting. For example, 810 nm is visible to the naked eye, whereas 940 nm is completely un-detectable to the naked eye. The benefit to the 810 nm LED, when used in combination with a night vision device, is extended range, as compared to using the invisible 940 nm LED which is much reduced in range. However, the benefit of the 940 nm is complete elimination of any visible light output, which could be detected by the targeted species. As with the visible light LED limitations previously discussed, the IR LED light as currently available possesses virtually identical limitations and shortfalls.

Therefore, the current disclosure seeks to solve the above-mentioned problems, as well as others.

SUMMARY OF EXAMPLE EMBODIMENTS

In one embodiment, a multi-color spotlight comprises a housing having a lens on a first side, a rotational mechanism, a knob for actuating the rotational mechanism, and a power supply source within the housing operably coupled to the rotational mechanism. In one embodiment, the rotational mechanism comprises a rotatable rod having a plurality of substrates coupled around the circumference thereof, each substrate having an LED chip mounted in the same vertical plane in relation to the other LED chips, and wherein only the LED chip that is positioned in the center beneath the lens of the housing is configured to receive power from the power supply source.

In one embodiment, a multi-color spotlight comprises a housing having a lens on a first side, a rotational mechanism, a knob for actuating the rotational mechanism, a power supply source within the housing operably coupled to the rotational mechanism, a bezel configured to broaden or focus the beam of light, and an intensity control mechanism (e.g., a rheostat).

DETAILED DESCRIPTION OF EXAMPLE EMBODIMENTS

Figure 1:
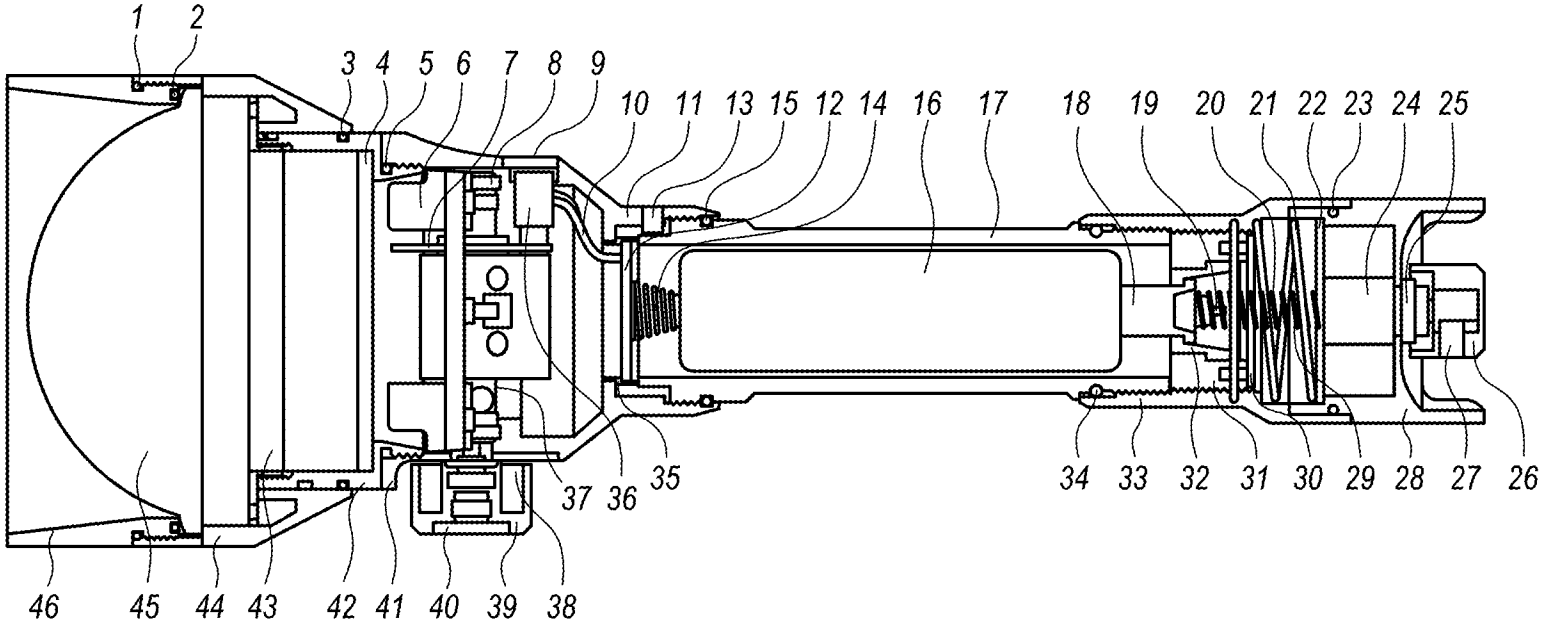
FIG. 1 is a cross-section of a side elevation view of a multi-color spotlight.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

The following reference numerals are used throughout the drawings:

| Reference# | Item |
|---|---|
| 1 | Rubber O-Ring |
| 2 | Rubber O-Ring |
| 3 | Rubber O-Ring |
| 4 | Aluminum cover |
| 5 | Rubber O-Ring |
| 6 | Plastic LED holder mounting unit |
| 6A | Screw |
| 7 | LED Switch Circuit (PCB) |
| 8 | Copper LED holder axle sleeve |
| 8A | Copper LED holder axle sleeve |
| 9 | Aluminum position fixing ring |
| 10 | Double wire |
| 11 | Aluminum LED holder mounting unit |
| 12 | LED constant-current drive circuit (PCB) |
| 13 | Screw |
| 14 | Spring |
| 15 | Rubber O-Ring |
| 16 | 18650 Lithium battery |
| 17 | Battery housing |
| 18 | Copper pillar |
| 19 | Copper nail |
| 20 | Spring |
| 21 | Big spring |
| 22 | Intensity control circuit (PCB) |
| 23 | Rubber O-Ring |
| 24 | Potentiometer with on/off button |
| 25 | Nut |
| 26 | Intensity knob |
| 27 | Screw |
| 28 | Tail cap back portion |
| 29 | Single wire |
| 30 | Printed Circuit Board |
| 31 | Aluminum ring |
| 32 | Plastic ring |
| 33 | Tail cap front portion |
| 34 | Rubber O-Ring |
| 35 | Copper ring |
| 36 | Spring thimble mount |
| 36A | Plastic cover |
| 36B | Spring thimble |
| 36C | Printed Circuit Board (PCB) |
| 37 | Copper LED holder |
| 37A | Screw |
| 37B | Screw |
| 37C | Screw |
| 37D | Plastic triangle unit |

-continued

| Reference# | Item |
|---|---|
| 37E | Copper substrate with first (e.g., Red) LED |
| 37F | Copper substrate with second (e.g., Green) LED |
| 37G | Copper substrate with third (e.g., White) LED |
| 37H | Plastic LED cover 1 |
| 37I | Plastic LED cover 2 |
| 37J | Plastic LED cover 3 |
| 37K | Spring |
| 37L | Sphere |
| 37M | First LED chip |
| 37N | Second LED chip |
| 37O | Sphere receiving aperture |
| 38 | Screw |
| 39 | Rotatable knob |
| 39A | Screw |
| 39B | Rubber O-Ring |
| 40 | Plastic screw cover |
| 41 | Aluminum LED holder mounting unit |
| 42 | First Focusing unit |
| 43 | Second Focusing unit |
| 44 | Third Focusing unit |
| 45 | Glass lens |
| 46 | Aluminum bezel |

As discussed in the Background section, despite the prior art's attempt to solve the problems with night hunting lights, several problems remain unsolved. Reviewing currently used technology, such as that disclosed in U.S. Pat. No. 7,802,901 (the '901 patent), one or more LEDs are located in close proximity to one another, and, importantly, are located on the same horizontal geometric plane. Despite the LED chips' close proximity to one another, the beam produced by each will be centered in a significantly different position at increasing distances. Due to this limitation, these designs are not practical for firearm-mounted night hunting lights. In other words, a hunter will sight-in the scope on the weapon and accompanying light, such that the light is focused and illuminates the crosshair position of the scope. If the technology disclosed in the '901 patent is used, a hunter can only align one LED beam with the crosshairs. If the hunter switches which LED chip is illuminated, the focus of the beam will not be aligned with the crosshairs. Therefore, there is a need for a multi-LED spotlight that allows a user to switch between varying LED chips without changing the focal-point of the beam. By incorporating a rotatable LED mechanism, described below, the present invention has been able to solve the above-mentioned problems and others.

Figure 2:
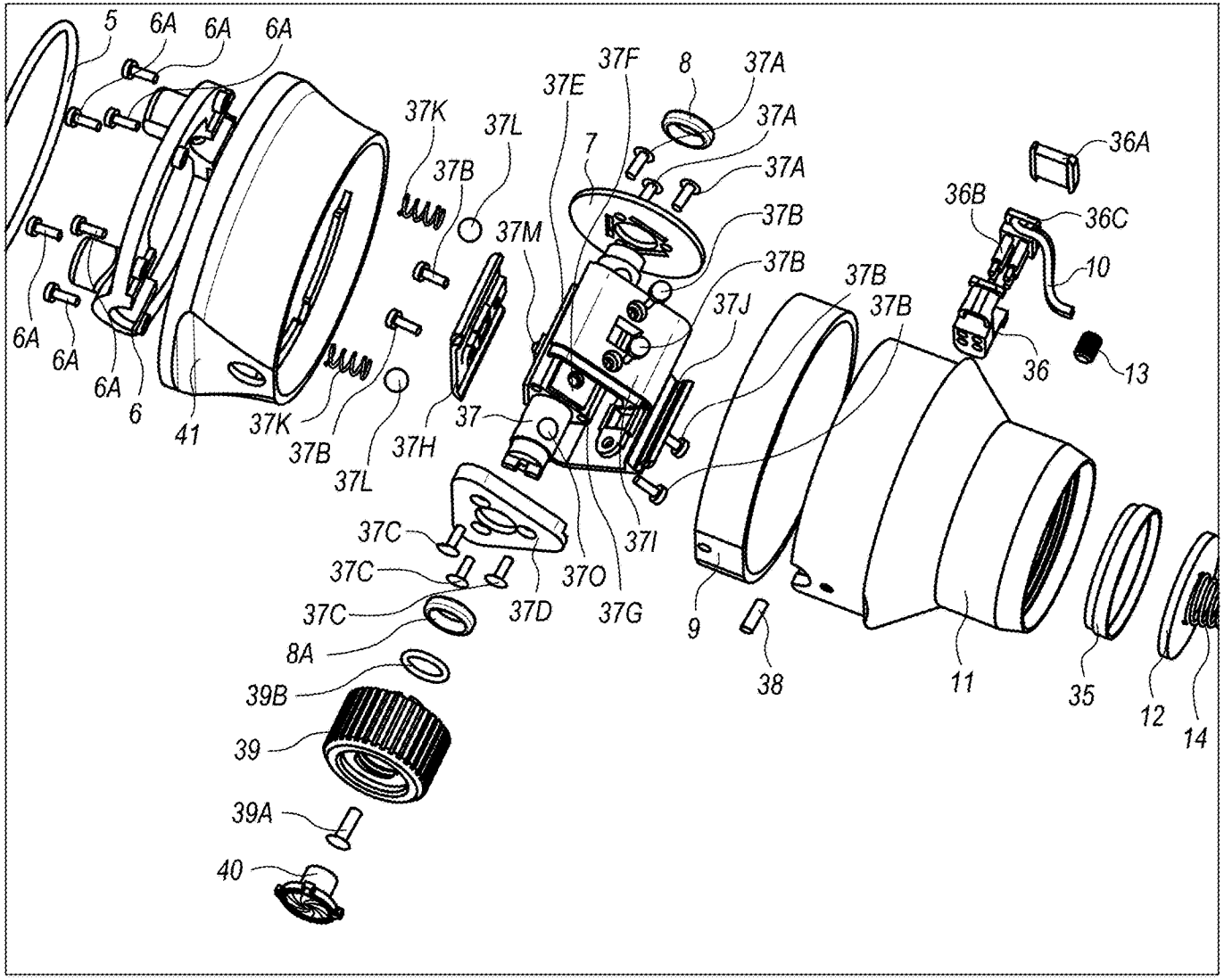
FIG. 2 is an exploded view illustrating a rotational mechanism portion of a multi-color spotlight.
Figure 3:
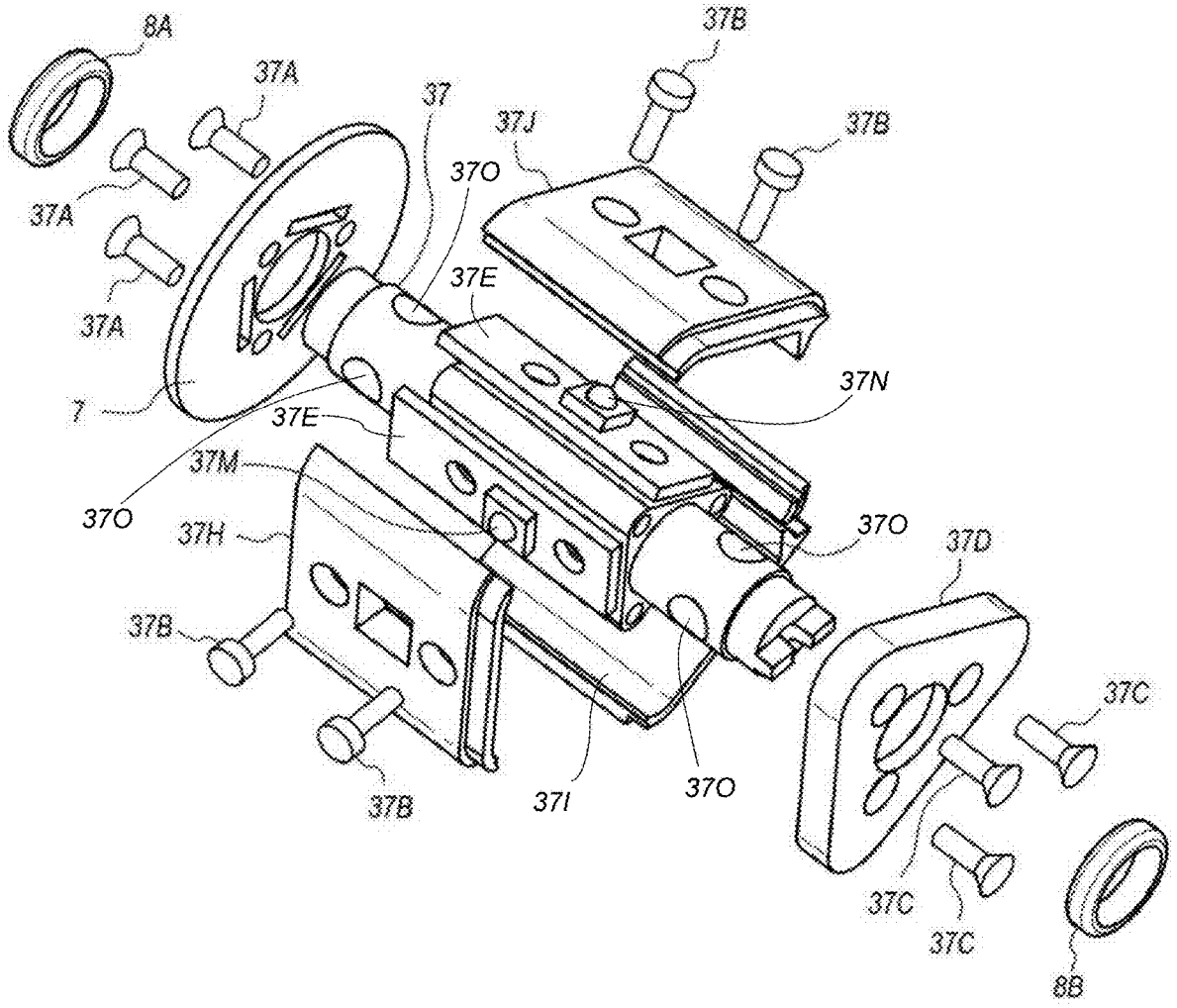
FIG. 3 is an exploded, detailed view of a rotational mechanism.

In one embodiment, generally shown in FIGS. 1-3, a multi-color spotlight comprises a lens 45, a rotational mechanism comprising a knob 39 for rotating a rotatable rod 37 having a plurality of light-emitting devices (e.g., Light-Emitting Diodes (LEDs), High Intensity Discharge Lamps (HIDs), Incandescent bulbs, etc.) thereon, and a power supply source (e.g., battery 16). The power supply source may be coupled to a potentiometer 24 (or similar mechanism known in the art, such as a rheostat) allowing the intensity of the light to be adjusted. The multi-color spotlight may also comprise a means for focusing the light, such as using focusing units 42-44, as is known in the art.

FIG. 2 illustrates an exploded view of the rotational mechanism of the multi-color spotlight. As shown, the rotational mechanism comprises a rotatable rod 37 having a plurality of substrates 37H-37J coupled around the circumference of the rotatable rod 37 such that each substrate 37H-37J is mounted in a distinct geometric plane from each other. Further, each substrate 37H-37J comprises an LED chip 37M, 37N (third chip not visible) thereon, with each LED chip being in the same vertical geometric plane. It will be noted that while only LED chip 37M and LED chip 37N are visible in the drawing, each substrate 37H-37J has its own unique color LED chip mounted thereon so that each chip is in the same vertical plane. Each substrate 37H-37J has a cover 37H-37J. Rotatable rod 37 is coupled to the rotatable knob 39 so that when a user actuates the rotatable knob 39, the rotatable rod 37 rotates about its longitudinal axis, which thereby rotates the substrates 37L-37N and accompanying LEDs. Because the LED chips are in the same vertical geometric plane, as the rotatable rod 37 rotates about the longitudinal axis, each LED chip is rotated to, end rests in, substantially the same position as the previous LED chip. In other words, the geometric location of each LED must be substantially the same on each substrate 37H-37J such that when rotated, the focal point of the illuminated LED is the same as the prior-illuminated LED. While LEDs are used as examples throughout this disclosure, it will be appreciated that any light-emitting device may be used without departing herefrom.

Figure 4:
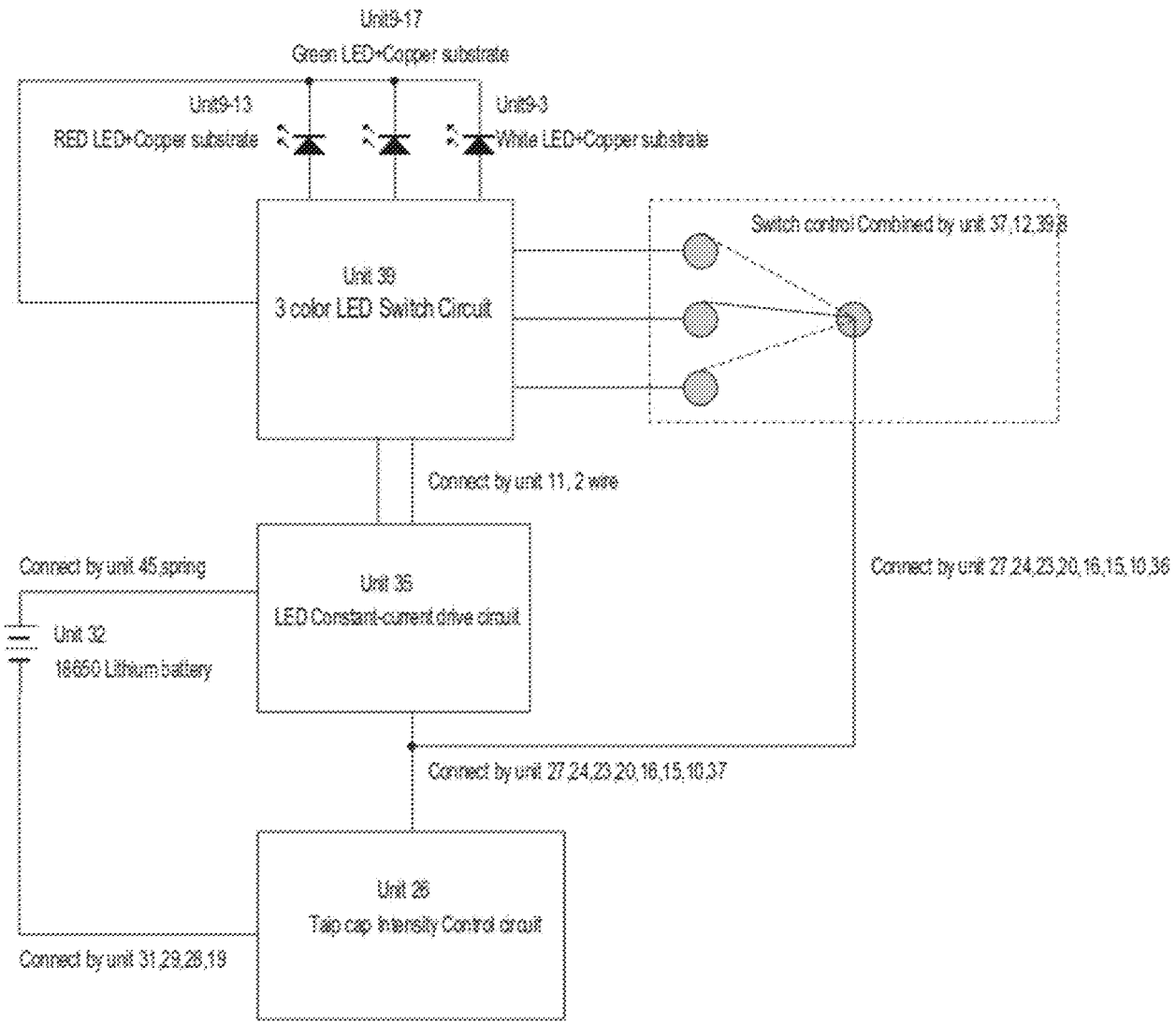
FIG. 4 is an electrical description of a multi-color spotlight.

Only the LED positioned beneath the lens 45, to direct light through the lens 45, is illuminated at any given time, while the remaining LEDs remain "off." This is accomplished using a power switching system, as best shown in FIG. 4, which illustrates an electrical description for the multi-color spotlight. As shown, a battery 16 is interposed between the intensity control circuit 22 and the LED constant-current drive circuit 12. The LED constant-current drive circuit 12 and the intensity control circuit 22 are coupled by a spring 21, the potentiometer 24, a nut 25, a tail cap back portion 28, a tail cap front portion 33, a battery housing 17, an aluminum mounting unit 11, and a copper ring 35. The LED constant-current drive circuit 12 is coupled to a switch control unit comprising (as best shown in FIG. 2) a spring thimble 36B, thimble mount 36, and circuit board 36C, which in turn is coupled to the LED switch circuit 7, which is coupled to, and controls, the LED chips 37M, 37N, and more, if present. While the examples illustrate the use of three LED chips, it will be appreciated that only two are required. Further, more than two LED chips are possible, with the maximum number being the number of LED chips that can be situated around the circumference of the rotatable rod 37 while remaining in the same vertical geometric plane. It will also be appreciated that a rotatable rod 37 may not be required. For example, the substrates 37H-37J may be coupled to each other along the edges, leaving a hollow center, with the knob 39 being coupled to the substrates 37H-37J so as to rotate them in the same manner as is accomplished by the rotatable rod 37. Other configurations achieving the same means, i.e., rotation of multiple LED chips so as to keep the same focal point, are contemplated herein and do not depart herefrom.

In one example of use, a user would turn "on" the multi-color LED spotlight by depressing intensity knob 26 (or twisting it, depending upon the configuration of the switch), and may also adjust the intensity of the light by rotating the intensity knob 26, which is coupled to the potentiometer 24. The LED chip that is positioned to direct light out of the lens 45 would then illuminate. If a user desired to change colors of light being emitted, the user would grasp knob 39 and rotate it, which rotates rod 37 and accompanying components, including LED switch circuit 7. As best seen in FIG. 2, as rod 37 rotates and reaches the next LED chip for illumination, the rod "clicks" into place using springs 37K and spheres 37L, which nest in sphere receiving apertures 37O. As the spheres 37L engage sphere receiving apertures 37O, the spring thimble 36B likewise engages the LED switch circuit 7, illuminating the appropriate LED (which, in this example, is the LED positioned between the sphere receiving apertures 37O that are engaged with the spheres 37L. However, the functionality is not dependent upon the spheres 37L engaging the sphere receiving apertures 37O next to the illuminated LED). This allows a user to more easily control where to stop the rotatable rod 37 so that the appropriate LED will illuminate—the user will feel the "click" and the LED will illuminate. As such, a user may quickly and easily rotate between colors without altering the illuminated area and without the need of accessories. Only slight pressure is required by a user to rotate rod 37, releasing spheres 37L from their respective receiving apertures 37O and disconnecting the spring thimble 36B from the LED switch circuit 7. The user then rotates the rod 37 until the spheres 37L "click" into the next receiving apertures 37O, engaging spring thimble 36B once again to the LED switch circuit 7, thereby illuminating the appropriate LED chip.

By utilizing a rotatable rod 37 with LED chips 37M-37N in the center thereof—or at least in the same vertical plane—and going around the circumference of the rotatable rod 37, the focus of the beam does not change when rotating to a different colored LED chip. In other words, as a non-limiting example, a first LED chip may produce a white light. A hunter may mount the multi-LED spotlight to a scope on a firearm and proceed to sight-in the focus point of the light with the crosshairs of the scope. When the hunter then desires to change from white light to, for example, a green light, the hunter may rotate the knob 39 until the spheres 37L are received within apertures 37O corresponding with the next sequential LED chip on the rotatable rod 37. As the spheres 37L are received, the spring thimble 36B engages the LED switch circuit 7, illuminating the green LED (provided that the green LED was next in the sequence of rotation. If not, the user would continue to rotate until the green LED illuminates). Because the green LED is in the same physical location that the white LED was in when it was sighted-in, the focal point of the green LED remains the same as the white LED. Accordingly, a user is able to switch between two or more beam colors without needing additional equipment, or adjustments to the windage or elevation of the light mount, and without altering the beam focus. This allows for quick, easy, and repeatable LED color changes with no position and/or orientation change to the light beam. This provides for enhanced ease of use and effective and accurate targeting of quarry through a scoped weapon during night hunting, overcoming the limitations of the prior art.

In one embodiment, a multi-color LED spotlight comprises a housing having a lens, a rotational LED mechanism, a knob for actuating the rotational LED mechanism, a power supply source within the housing operably coupled to the rotational LED mechanism, a bezel configured to broaden or focus the beam of light, and an intensity control mechanism (e.g., a rheostat, potentiometer, or equivalent means). In one embodiment, the rotational LED mechanism comprises a plurality of LED chips mounted in separate horizontal planes, but in the same vertical geometric plane, and rotatable such that the LED rotation creates a circle in the same plane, each LED illuminating when it is positioned to produce a beam of light out of the lens. While LEDs (Light-Emitting Diodes) are used as an example throughout the description, it will be appreciated that other means for producing light (any light-emitting device) may also be used without departing herefrom.

While the forgoing examples are illustrative of the principles of the present invention in one or more particular applications, it will be apparent to those of ordinary skill in the art that numerous modifications in form, usage, and details of implementation can be made without the exercise of inventive faculty, and without departing from the principles and concepts of the invention. Accordingly, it is not intended that the invention be limited, except as by the claims set forth below.

What is claimed is:

1. A multi-color spotlight, comprising:

a housing;

a lens having convex forward surface and a focal point;

a plurality of light-emitting devices positioned in a single vertical geometric plane that passes through the lens focal point and through each of the plurality of light-emitting devices; and a battery;

wherein each light-emitting device is selectively positionable to a center position beneath the lens;

wherein only the light-emitting device positioned at the center position beneath the lens is illuminated.

2. The multi-color spotlight of claim 1, further comprising a rotational mechanism for selectively positioning the light-emitting devices.

3. The multi-color spotlight of claim 1, further comprising an intensity control mechanism.

4. The multi-color spotlight of claim 1, further comprising a bezel configured to broaden or focus the beam of light.

5. A method of positioning multiple light-emitting devices in a spotlight so that each light-emitting device maintains the same focal point when selectively illuminated, the method comprising:

selecting a first light-emitting device by positioning the first light-emitting device at a first position beneath a lens, the first light-emitting device having a focal point;

selectively positioning the first light-emitting device at a second position and a second light-emitting device to the first position beneath the lens, the second light-emitting device having a focal point;

wherein the focal point of the first and second light-emitting devices remains the same when selectively illuminated; and wherein the first light-emitting device and the second light-emitting device both remain in a single vertical geometric plane that passes through the focal point.

6. The method of claim 5 further comprising the step of clicking the second light-emitting device into position when thee second light-emitting device is selectively positioned in the first position beneath the lens.

7. The method of claim 6 wherein clicking the second light-emitting device into position comprises an audible click.

8. The method of claim 7 wherein clicking the second light-emitting device into position comprises a felt click.

9. The method of claim 5 wherein the step of positioning the first light-emitting device at a first position beneath a lens comprises positioning the first light-emitting device at a focal point of convex lens.

10. The method of claim 5 further comprising the step of rotating a bezel to focus or broaden a beam of light emitted by the spotlight.

11. The method of claim 10 wherein selectively positioning the second light-emitting device to the first position beneath the lens does not alter the focus of the beam of light.

12. A multi-color spotlight for emitting a beam of light, comprising:

a housing;

a focal point;

a plurality of light sources in a single vertical geometric plane that passes through the focal point and through each of the plurality of light sources, wherein each light source is selectively positionable at the focal point;

a detent that clicks indicating that one of the light sources is positioned at the focal point; and a battery;

wherein only the light source positioned at the focal point is illuminated.

13. The multi-color spotlight of claim 12 wherein the detent clicks with an audible click.

14. The multi-color spotlight of claim 12 wherein the detent clicks with a felt click.

15. The multi-color spotlight of claim 12 wherein the detent comprises a sphere.

16. The multi-color spotlight of claim 15 wherein the detent comprises an aperture that engages the sphere.

17. The multi-color spotlight of claim 12 wherein the detent comprises a spring.

18. The multi-color spotlight of claim 12, further comprising a lens focused at the focal point and having a convex forward surface.

19. The multi-color spotlight of claim 18, further comprising a bezel configured to broaden or focus the beam of light by moving the lens relative to the light source and in the vertical geometric plane.

20. The multi-color spotlight of claim 1, further comprising a detent that clicks indicating that one of the light sources is positioned at the focal point.

* * * * *